US010385690B2

(12) United States Patent
Roth

(10) Patent No.: US 10,385,690 B2
(45) Date of Patent: Aug. 20, 2019

(54) SHANK CHISEL AND FIXING ASSEMBLY FOR A SHANK CHISEL

(71) Applicant: Betek GmbH & Co. KG, Aichhalden (DE)

(72) Inventor: Markus Roth, Aichhalden (DE)

(73) Assignee: Betek GmbH & Co. KG, Aichhalden (DE)

( * ) Notice: Subject to any disclaimer, the term of this patent is extended or adjusted under 35 U.S.C. 154(b) by 64 days.

(21) Appl. No.: 15/345,581

(22) Filed: Nov. 8, 2016

(65) Prior Publication Data

US 2017/0074098 A1 Mar. 16, 2017

Related U.S. Application Data

(63) Continuation of application No. PCT/EP2015/060070, filed on May 7, 2015.

(30) Foreign Application Priority Data

May 8, 2014 (DE) ..... 10 2014 106 484

(51) Int. Cl.
*E21C 35/19* (2006.01)
*E21C 35/197* (2006.01)
(Continued)

(52) U.S. Cl.
CPC ..... *E21C 35/19* (2013.01); *E21C 35/183* (2013.01); *E21C 35/197* (2013.01); *E21C 2035/1803* (2013.01)

(58) Field of Classification Search
CPC ..... E21C 35/18
See application file for complete search history.

(56) References Cited

U.S. PATENT DOCUMENTS 3,101,934 A * 8/1963 Poundstone ..... E21C 35/18 279/16
4,149,753 A 4/1979 Stoltz et al.
(Continued)

FOREIGN PATENT DOCUMENTS

DE 2630276 C2 6/1985
DE 3701905 C1 9/1988
(Continued)

OTHER PUBLICATIONS

Japanese Office Action (Application No. 2017-510758) dated Dec. 4, 2017 (with English translation).
(Continued)

*Primary Examiner* — Janine M Kreck
(74) *Attorney, Agent, or Firm* — Burr & Brown, PLLC

(57) ABSTRACT

The present invention relates to a shank chisel with a chisel head and a chisel shank, wherein the chisel shank has a securing element receptacle in which a securing element is arranged. In order to be able to make simple installation of the shank chisel in a chisel holder possible in a safe and maintenance-optimized manner of operation, it is provided according to the invention that a clamping element is adjustable relative to the chisel shank in such a manner that at least one part of the outer contour of the securing element is changed. The invention furthermore relates to a corresponding fixing assembly for a shank chisel in a chisel holder.

17 Claims, 6 Drawing Sheets

(51) Int. Cl.
*E21C 35/183* (2006.01)
*E21C 35/18* (2006.01)

(56) References Cited

U.S. PATENT DOCUMENTS

| | | | | |
|---|---|---|---|---|
| 4,818,027 | A | 4/1989 | Simon | |
| 5,992,405 | A | 11/1999 | Sollami | |
| 6,364,420 | B1 * | 4/2002 | Sollami | B28D 1/188 299/104 |
| 9,222,354 | B2 * | 12/2015 | Allgaier | E21C 35/18 |
| 2008/0164073 | A1 | 7/2008 | Hall et al. | |
| 2009/0261646 | A1 | 10/2009 | Ritchey et al. | |
| 2012/0080930 | A1 | 4/2012 | Latham | |
| 2014/0217806 | A1 | 8/2014 | Allgaier et al. | |
| 2015/0300166 | A1 * | 10/2015 | Ries | E21C 35/1933 299/105 |
| 2015/0345291 | A1 | 12/2015 | Roth et al. | |
| 2016/0230551 | A1 | 8/2016 | Lehnert et al. | |

FOREIGN PATENT DOCUMENTS

| | | | |
|---|---|---|---|
| DE | 10 2005 001 535 | B3 | 8/2006 |
| DE | 10 2011 054 384 | A1 | 4/2013 |
| DE | 20 2012 100 353 | U1 | 6/2013 |
| GB | 2505569 | A | 3/2014 |
| RU | 2027852 | C1 | 1/1995 |
| RU | 2258808 | C1 | 8/2005 |
| SU | 875024 | A1 | 10/1981 |
| SU | 1819325 | A3 | 5/1993 |
| WO | 96/08599 | A1 | 3/1996 |
| WO | 2013/053811 | A2 | 4/2013 |
| WO | 2015/043884 | A2 | 4/2015 |

OTHER PUBLICATIONS

Russian Office Action and Search Report, Russian Application No. 2016147905/03 (076994), dated May 7, 2015 (7 pages).

International Search Report and Written Opinion (Application No. PCT/EP2015/060070) dated Nov. 13, 2015.

Russian Office Action (Application No. 2016147905/03(076994) dated Dec. 11, 2017.

Chinese Office Action (Application No. 201580037420.X) dated Feb. 27, 2018 (with English translation).

* cited by examiner

SHANK CHISEL AND FIXING ASSEMBLY FOR A SHANK CHISEL

CROSS REFERENCE TO RELATED APPLICATIONS

This application is a continuation of International Application No. PCT/EP2015/060070 filed May 7, 2015, which designated the United States, and claims the benefit under 35 USC § 119(a)-(d) of German Application No. 10 2014 106 484.4 filed May 8, 2014, the entireties of which are incorporated herein by reference.

FIELD OF THE INVENTION

The present invention relates to a shank chisel with a chisel head and a chisel shank, wherein the chisel shank has a securing element receptacle in which a securing element is arranged.

Furthermore, the present invention relates to a fixing assembly for a shank chisel in a chisel receptacle of a chisel holder, wherein the shank chisel has a chisel head and chisel shank, wherein the chisel shank together with a clamping element forms a securing element receptacle for a securing element.

BACKGROUND OF THE INVENTION

DE 3701905 C1 discloses a round shank chisel which consists of a chisel head and a chisel shank, wherein the chisel shank has a circumferential groove with a longitudinally slotted clamping sleeve mounted therein. Before the chisel shank is inserted into a bore of a holder, the clamping sleeve is held in a clamping position by means of a clamping member. After the chisel shank is inserted into the bore, the chisel shank, with the clamping sleeve sitting in the bore under tension, is secured axially, but mounted in a freely rotatable manner.

Furthermore, a fixing assembly with a shank chisel is described in DE 102005001535 B3. The fixing of the shank chisel in a chisel holder during the operating mode permits a movement here in the axial and in the circumferential direction. For this purpose, the shank chisel in a chisel receptacle of the chisel holder has a fastening portion with a functional surface which is operatively connected to a mutually corresponding mating surface of a securing ring. In the disclosed embodiment, axial play is produced between the shank chisel and the securing ring in a first working position, and, in a second working position, clamping between the functional surface and the mating surface of the securing ring, and also an inner surface of the chisel receptacle is produced.

The free rotatability is of advantage with the use of shank chisels with conventional chisel tips since the chisel tip on the shank chisel are customarily subject to increased wear relative to the holder. By rotation of the chisel, a more uniform abrasion of the chisel tip can be achieved in comparison to a non-rotating fixing, and the service life of the chisel and a maintenance interval associated therewith can thus be extended. However, the rotational movement of the chisel may cause increased abrasion of the chisel holder by frictional wear, in comparison to non-rotating chisels. In addition, devices which provide a rotatable fastening of the chisel to the chisel holder are frequently more complicated, for example, in terms of installation and removal.

New hard materials which exceed the degree of hardness of materials previously used for chisel tips nowadays permit the provision of virtually wear-free chisel tips. The use of such a chisel tip also permits a non-rotatable fixing on the chisel holder.

SUMMARY OF THE INVENTION

The present invention is based on the object of providing a shank chisel and fixing for a shank chisel, wherein simple installation of a shank chisel in a chisel holder is made possible in a safe and maintenance-optimized manner of operation.

The object relating to the shank chisel is achieved with the features of a first embodiment of the present invention. It is provided here that a clamping element is adjustable relative to the chisel shank in such a manner that at least one part of the outer contour of a securing element is changed, in particular, deformed. The shank chisel can thus be secured in a simple manner, for example, also non-rotatably, in a chisel holder.

The object relating to the fixing assembly is achieved with the features of a second embodiment of the present invention. It is provided here that the clamping element is adjustable relative to the chisel shank, and that the volume of the securing element receptacle can be changed by adjustment of the clamping element relative to the chisel shank. The chisel shank can simply be inserted here into the chisel receptacle of a chisel holder. The shank chisel is then fastened by tightening of the securing element. This installation can be carried out simply and unambiguously even at blind locations and during rough construction site operation. It is advantageously provided here that the chisel shank and the clamping element are connected in an infinitely adjustable manner to each other via a connecting element and a receptacle. The adjustment, in particular, the deformation, of the securing element can thus take place in a defined manner, for example, by application of a certain torque. The connecting element can be located either on the chisel shank or on the clamping element, and the receptacle can be located in a correspondingly complementary manner on the clamping element or on the chisel shank. A variant which can be manufactured simply can be the design of the connecting element or of the receptacle as a thread.

A preferred refinement possibility for protecting the securing element against damage, for example, due to excessive deformation is such that the adjustment of the clamping element relative to the chisel shank is limited by means of a stop.

It is expedient that a chisel tip composed of hard material with a hardness of at least 25 GPa is fastened to the chisel head. For example, the chisel tip can be composed of cubic boron nitride. For particularly wear-intensive applications, a hardness of at least 40 GPa can also be provided for the chisel tip. This can be achieved, for example, with polycrystalline diamond. A resulting high degree of stability of the tip against wear permits a non-rotatable securing of the chisel on the chisel holder, which can result in lower wear to the chisel holder in comparison to a rotatable securing. It is, therefore, also possible to optionally dispense with an anti-wear disk between chisel and chisel holder.

For a simple and defined installation, for example, by means of a wrench or torque wrench, and for simple removal, it is provided that the chisel head has a tool receptacle for securing a tool in an interlocking manner in the circumferential direction. The tool receptacle is generally readily accessible in the region of the chisel head.

A stable guidance of the shank and fastening in a manner stable against tilting and also minimized wear are produced by the fact that at least one part of the chisel shank is formed in a step-like manner by a first cylindrical portion, a transition and a second cylindrical portion.

An embodiment in which the chisel shank, the clamping element and the securing element form a fastening unit facilitates the installation insofar as the fastening unit can be introduced in completely preassembled form into the chisel holder.

The fact that the securing element has an annular securing element outer surface, an annular securing element inner surface and two radially directed securing element end surfaces has a positive effect on the fastening properties of the securing element relative to the chisel holder. Such a configuration of the securing element can produce an effective clamping pressure even with little adjustment of the clamping element. In addition, such a securing element can also be manufactured in a simple manner. Another advantageous variant embodiment of the securing element would be, for example, an O ring. This securing element can be obtained cost-effectively as a standard component and has sufficient stability in terms of pressure for the present application.

Furthermore, the possibility that the securing element is at least partially composed of elastic material permits simple production of the securing element with simultaneously good adjustability which can then take place, in particular, by means of deformation.

The configuration of the clamping element such that it has a holding surface for twist proof securing on the chisel holder permits a rotation-free mounting of the chisel on the chisel holder, which can result in a smaller degree of wear on the chisel holder compared to a rotatable securing. It is therefore also possible to omit an anti-wear disk between chisel and chisel holder. Furthermore, the clamping element is then held by the chisel holder upon tightening and does not have to be held with an additional tool. The installation is therefore further simplified.

Simple and definable axial fastening of the chisel on the chisel holder is produced by the fact that the securing element is adjustable, in particular, deformable, by changing the volume of the securing element receptacle, in order, by means of the resulting forces on the surrounding walls of the securing element receptacle, to achieve fixing in the axial direction between shank chisel and chisel holder.

Furthermore, a limiting of the minimum volume of the securing element receptacle by a spacer has the effect that a securing element located in the volume is protected against damage due to excessive adjustment, in particular, deformation.

In addition, in an advantageous variant embodiment, the clamping element is mounted in a twist proof manner in a clamping element receptacle of the chisel holder, and/or in that the clamping element is guided in an axially displaceable manner in the clamping element receptacle. The twist proof mounting facilitates the installation insofar as a separate holding element for holding the clamping element is not required since the chisel holder takes on this function. Furthermore the axial displaceability in the guidance of the clamping element permits the clamping element to be adjusted relative to the chisel which rests on a supporting region of the chisel holder. In addition, a space which can serve as a repositioning space, for example, in the event of wear of the supporting region, can be formed between clamping element receptacle and clamping element.

It is of advantage with regard to a stable guidance of the shank and fastening in a manner stable in terms of tilting, if it is provided that the chisel holder has a chisel receptacle which is formed in a step-like manner by a first cylindrical region, a transition region and a second cylindrical region. There is a positive effect here on the wear properties if the transition of the shank chisel and the transition region of the chisel receptacle are spaced apart axially from each other in such a manner that they form a repositioning space.

BRIEF DESCRIPTION OF THE DRAWINGS

The present invention is explained in more detail below using exemplary embodiments with reference to the drawings, in which.

DETAILED DESCRIPTION OF THE INVENTION

Figure 1:
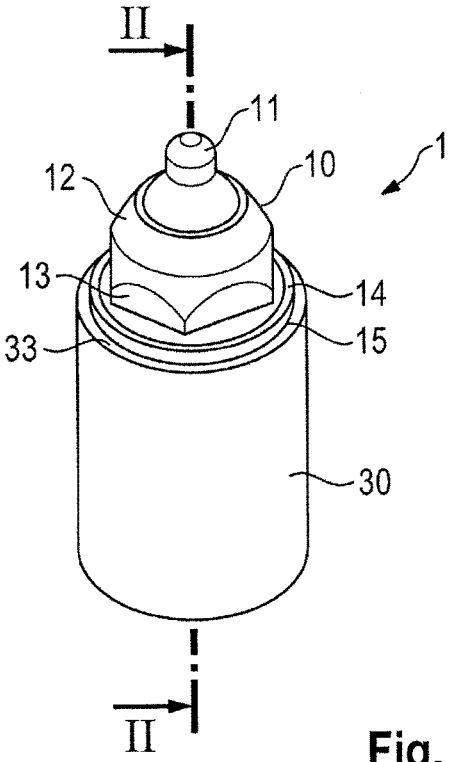
FIG. 1 shows a shank chisel and a chisel holder in a perspective illustration.

FIG. 1 shows a tool combination with a shank chisel 10 and a chisel holder 30. As this illustration reveals, the shank chisel 10 is mounted in the chisel holder.

Figure 2:
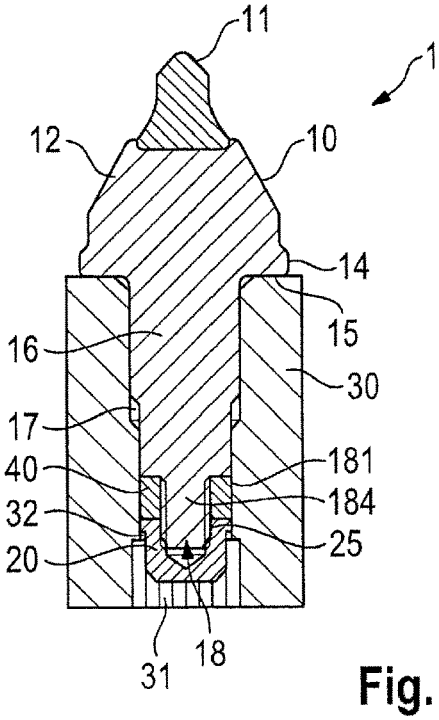
FIG. 2 shows the illustration according to FIG. 1 along the section profile marked by II-II in FIG. 1.

FIG. 2 reveals the assignment of the shank chisel 10 to the chisel holder 30 in more detail. The chisel holder 30 is shown in more detail in FIGS. 7 and 8. As these illustrations reveal, the chisel holder 30 has a chisel receptacle in the form of a stepped bore. The chisel receptacle here has a first cylindrical region 35 which merges via an entry bevel 34 into an annular surface running radially with respect to the bore axis. The annular surface forms a supporting region 33. A transition region 36 adjoins the first cylindrical region in a manner facing away from the entry bevel 34. The transition region 36 is designed in the form of a conical bore geometry. Following the transition region 36, the chisel receptacle 301 has a second cylindrical region 37. The second cylindrical region 37 is arranged coaxially with respect to the first cylindrical region 35. Finally, the chisel receptacle 301 has a further region which can be seen in FIG. 8 and forms a clamping element receptacle 31. For this purpose, the chisel holder 30 is provided with an aperture which is provided in the rear side region of the chisel holder, the rear side region facing away from the supporting region 33.

Figure 7:
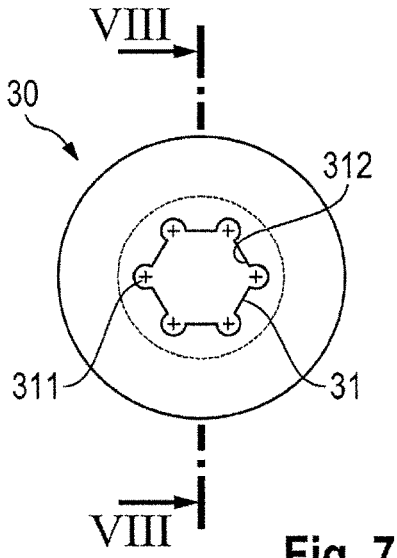
FIG. 7 shows the chisel holder according to FIGS. 1 and 2, in a view from below.
Figure 8:
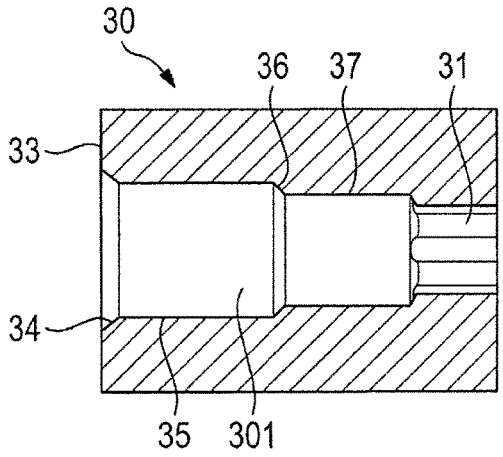
FIG. 8 shows the chisel holder according to FIG. 7 along the sectional profile marked by VIII-VIII in FIG. 7.

FIG. 7 reveals the configuration of the clamping element receptacle 31 in more detail. As this illustration shows, the clamping element receptacle is bounded by shaped surfaces 312 which are at an angle to one another. The shaped surfaces 312 extend here axially to the center longitudinal axis of the chisel receptacle 301. Recesses 311 are provided in the transition region between the shaped surfaces 312. The recesses 311 provide a clamping-optimized transition between the shaped surfaces 312. In the present exemplary embodiment, six shaped surfaces 312 are used and therefore form a hexagon receptacle, as is known, for example, in the case of a nut of a ratchet wrench. A different number of shaped surfaces, for example, in order to form a triangular or square receptacle, etc., is also conceivable.

As FIG. 2 furthermore shows, the tool combination has the shank chisel 10 already mentioned above. The shank chisel 10 is shown in more detail in FIGS. 3 and 4. As FIG. 4 shows, the shank chisel 10 has a chisel head 12 on which a chisel shank 16 is integrally molded. The chisel head 12 of the shank chisel 10 has a chisel tip 11 which is composed of hard material and is preferably soldered onto the chisel head 12. Starting from the chisel tip 11 which, for reasons of better clarity, is not illustrated in FIG. 4, but can be seen in FIG. 3, the cross section of the chisel head increases in a manner similar to a circular cone. Finally, the portion similar to a circular cone merges into a tool receptacle 13 which is formed from surfaces for securing a tool in an interlocking manner in the circumferential direction. The surfaces permit the installation and removal, for example, by means of a wrench which may also be a torque wrench. The tool receptacle 13 is adjoined by an edge 14 which forms a supporting surface 15. In the region of the annular supporting surface, the chisel shank 16 adjoins the chisel head via a rounding transition. The chisel shank 16 is designed as a stepped shank. It has a first cylindrical portion 161 which, facing away from the chisel head, merges via a transition 162 into a second cylindrical portion 163. The second cylindrical portion 163 is adjoined by a connecting element 184 facing away from the chisel head 12. In the present case, the connecting element 184 is designed in the form of a threaded bolt which is connected integrally to the chisel shank 16. A first functional surface 182 is formed in the transition region between the connecting element 184 and the second cylindrical portion 163. The first functional surface 182 is designed in the form of an annular surface running radially with respect to the center longitudinal axis of the shank chisel 10. The connecting element 184 forms a lateral functional surface 183 which, in the present case, is formed by the threaded portion. At the free end, the connecting element 184 forms an end piece which is provided with a stop 186. The stop 186 is formed here by a conical tip. It is also conceivable for the stop 186 to be formed by a further cylindrical portion in the transition between the second cylindrical portion 163 and the connecting element 184. The further cylindrical portion could simultaneously constitute the lateral functional surface 183.

Figure 3:
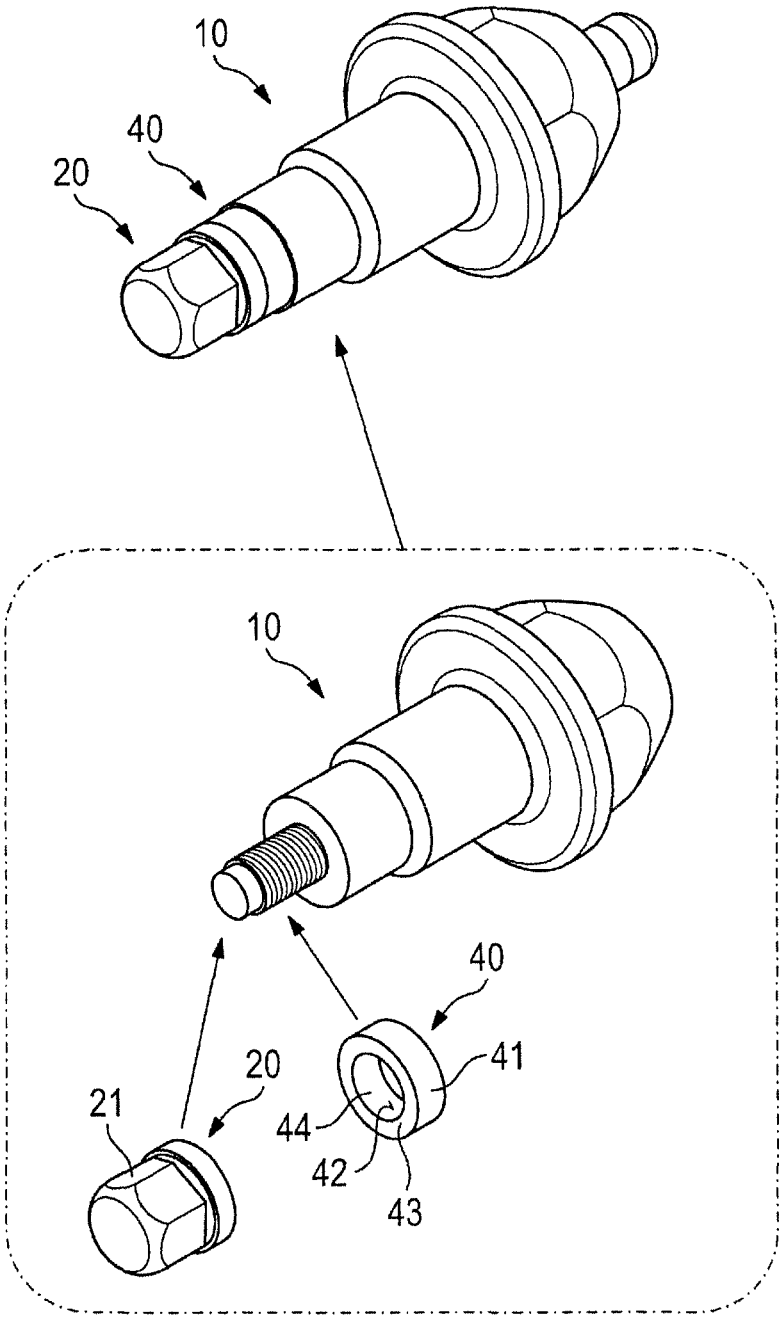
FIG. 3 shows a perspective illustration of the assembly of a shank chisel.
Figure 4:
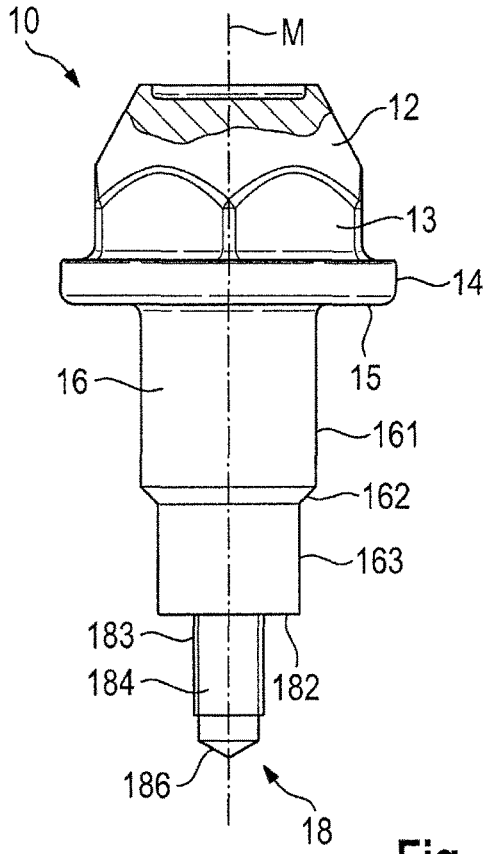
FIG. 4 shows the shank chisel according to FIG. 3 in a side view and in partial section.

As FIGS. 2 and 3 show, the tool combination furthermore comprises a clamping element 20. The clamping element 20 is designed in a manner similar to a cap nut. The precise configuration of the clamping element 20 can be gathered from FIGS. 5 and 6. As these illustrations show, the clamping element 20 has a cap portion which is bounded circumferentially by holding surfaces 21. The holding surfaces 21 are arranged hexagonally with respect to one another here, similarly as in a nut. An encircling bevel 22 is provided at the closed end of the clamping element and merges into an end-side boundary wall. The clamping element 20 has, facing away from the boundary wall, an attachment 26 which, via a projection 261, integrally adjoins the region which forms the holding surfaces 21. In the region of its lower side, the clamping element, as FIG. 6 reveals, is bounded by a second functional surface 262. The second functional surface 262 is configured annularly and runs radially with respect to the center longitudinal axis of the clamping element 20. The second functional surface 262 merges via a bevel 27 into a receptacle 25 which, in the present case, is designed as a threaded receptacle. The receptacle 25 ends in a conical bore portion. The conical bore portion forms a stop surface 23. It is also conceivable that, instead of a conical bore portion, use is made here of any other geometry which forms a stop surface 23. For example, the receptacle may also be designed as a blind bore or the like.

Figure 5:
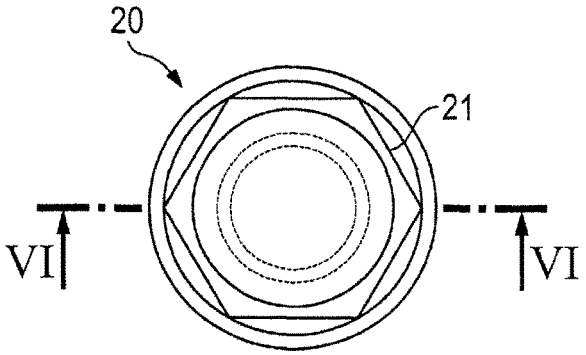
FIG. 5 shows a clamping element in top view.
Figure 6:
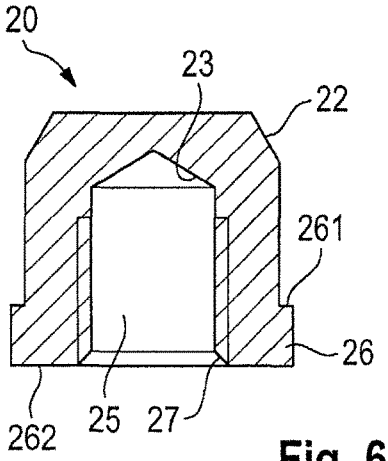
FIG. 6 shows the clamping element according to FIG. 5 along the sectional profile marked by VI-VI in FIG. 5.

The clamping element 20 according to FIGS. 5 and 6 has the holding surfaces in the form of a hexagonal arrangement, as has been described above. Of course, another geometry may also be selected in this region. For example, it is conceivable to use only one holding surface. Triangular or square geometries etc., are also conceivable. In order to carry out its functionality, which is explained in more detail below, the holding surface 21 is intended to form a lock in the circumferential direction.

As FIG. 3 reveals, the tool arrangement also comprises a securing element 40. The securing element 40 is formed from an elastic material, for example, a rubber-like material, etc. It has an annular securing element outer surface 41 and an annularly designed securing element inner surface 42. The securing element outer surface 41 and the securing element inner surface 42 are connected to each other by means of radially running securing element end surfaces. The securing element end surfaces 43 run parallel to one another and are arranged opposite one another on the securing element 40. The securing element 40 is penetrated by a central aperture 44.

For the installation of the securing element 40, the latter, as FIG. 3 shows, is pushed with its central aperture 44 onto the connecting element 184 of the shank chisel. The pushing-on movement is limited here by one of the securing element end surfaces 43. The securing element end surface 43 strikes against the first functional surface 182 of the chisel shank 16. The clamping element 20 is subsequently placed onto the connecting element 184. This installation movement is facilitated here by the bevel 27. The bevel 27 slides onto the stop 186. The clamping element 20 can subsequently be screwed with its internal thread, which is provided in the region of the receptacle 25, onto the external thread of the connecting element 184. The threaded connection is preferably designed here with self-locking. This prevents the clamping element 20 from being able to unscrew automatically from the chisel shank 16. When the clamping element 20 is adjusted relative to the chisel shank 16, the second functional surface 262 is placed onto the securing element end surface 43 that faces away from the first functional surface 182. The shank chisel 10 according to FIG. 3 is preassembled here in such a manner that the securing element 40 still does not experience any deformation state or experiences only a small deformation state. The chisel shank 16, the clamping element 20 and the securing element 40 form a fastening unit 18 in this case.

As FIG. 2 reveals, the preassembled shank chisel 10 can be inserted into the chisel receptacle 301 of the chisel holder 30. The insertion of the shank chisel 10 into the chisel receptacle is facilitated with the stepped shank design and the stepped bore design of the chisel holder 30. By this means, the shank chisel 10 can simply be introduced at its free end into the chisel receptacle 301, which affords advantages, in particular, in respect of blind installation circumstances. In the mounted state, as FIG. 2 shows, the chisel shank 16 is situated in the chisel receptacle 301 in such a manner that the first and the second cylindrical portion 161 and 163 of the chisel shank 16 come to lie respectively in the first and second cylindrical regions 35 and 37 of the chisel receptacle. The assignment is selected here in such a manner that the transition 162 of the chisel shank is arranged axially spaced apart from the transition region 36 of the chisel receptacle 301. This produces a repositioning space 17 which can be seen clearly in FIG. 2. The shank chisel 10 which is inserted into the chisel receptacle 301 can now be fastened in a simple manner in the chisel holder 30. For this purpose, a suitable screwing tool, for example, a torque wrench, is placed onto the tool receptacles 13 in the region of the chisel head 12. The clamping element 20 is accommodated in the clamping element receptacle 31 in such a manner that the holding surfaces 21 lie against the shaped surfaces 312 of the clamping element receptacle 31 in an interlocking manner in the circumferential direction. This prevents the clamping element 20 from being able to rotate when the shank chisel 10 is rotated with the tool. The shaped surfaces 312 and the holding surfaces 21 form as it were a sliding guide in the axial direction of the shank chisel 10. When the shank chisel 10 is tightened, the clamping element 20 slides into the sliding guide. In this case, a space 32 between the attachment 26 and the upper edge of the clamping element receptacle 31 is enlarged. This space 32 likewise forms a repositioning space.

If the clamping element 20 is now tightened, the volume of a securing element receptacle 181 (see FIG. 2) in which the securing element 40 is accommodated changes. The securing element receptacle 181 is bounded here by the lateral functional surface 183 of the connecting element 184, by the first functional surface 182 of the chisel shank 16 and by the second functional surface 262 of the clamping element 20. If the clamping element 20 is therefore now adjusted in the direction of the chisel head 12, the available volume within the securing element receptacle 181 is reduced, which leads to a deformation of the elastic securing element 40. As a consequence of the deformation and because of the lack of other yielding possibilities, the outer circumference of the securing element 40 increases in such a manner that it is placed against the inner wall of the chisel receptacle 301 with a clamping effect. In detail, the securing element 40 therefore presses with its securing element outer surface 41 against the inner wall of the second cylindrical region 37. At the same time, the securing element inner surface 42 is placed against the outer contour of the lateral functional surface 183. In this manner, a fastening of the shank chisel 10 in a captive manner in the axial direction of the shank chisel 10 can be undertaken by the securing element 40. At the same time, the shank chisel 10 is secured non-rotatably in the chisel receptacle 301 by the clamping element 20.

FIGS. 9 to 13 illustrate a second variant embodiment of the present invention. The construction of this second refinement of the invention substantially coincides with configuration features of the previously mentioned variant of the invention. Identical configuration features are marked by the same reference numbers. Reference may therefore be made to the above explanations in order to avoid repetitions. Only the differences of the second variant configuration will be discussed below.

Figure 9:
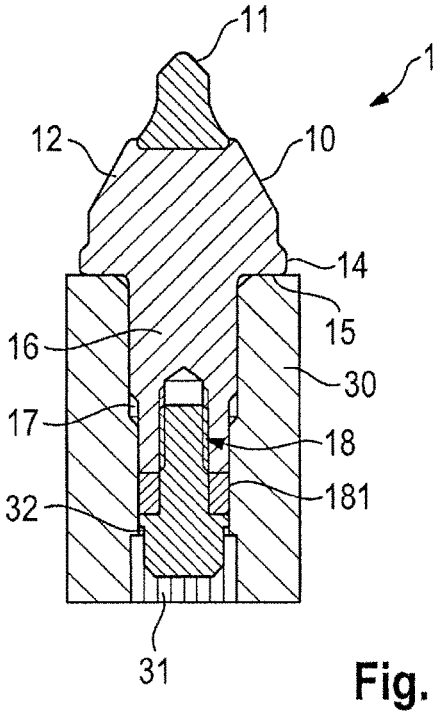
FIG. 9 shows a sectional illustration of a tool combination with a shank chisel and a chisel holder.

As FIG. 9 shows, the fixing assembly 1 again has a shank chisel 10, a chisel holder 30, a clamping element 20 and a securing element 40. The chisel holder 30 and the securing element 40 are configured identically to the chisel holder 30 and the securing element 40 according to the previously described variant embodiment.

The shank chisel 10 is provided in the region of its free shank end with a receptacle 25 in the form of a threaded receptacle. The receptacle 25 is introduced into the first functional surface 182 coaxially with respect to the center longitudinal axis of the shank chisel 10.

Figure 13:
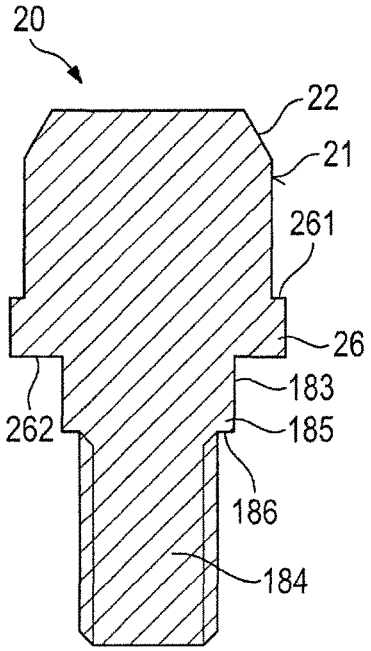
FIG. 13 shows the clamping element according to FIG. 12 along the sectional profile marked by XIII-XIII in FIG. 12.

In a manner corresponding to the receptacle 25, which is provided with the internal thread, the clamping element 20 now has an extension which is provided with an external thread, as FIG. 13 clearly reveals. The external thread forms the connecting element 184 here.

Figure 10:
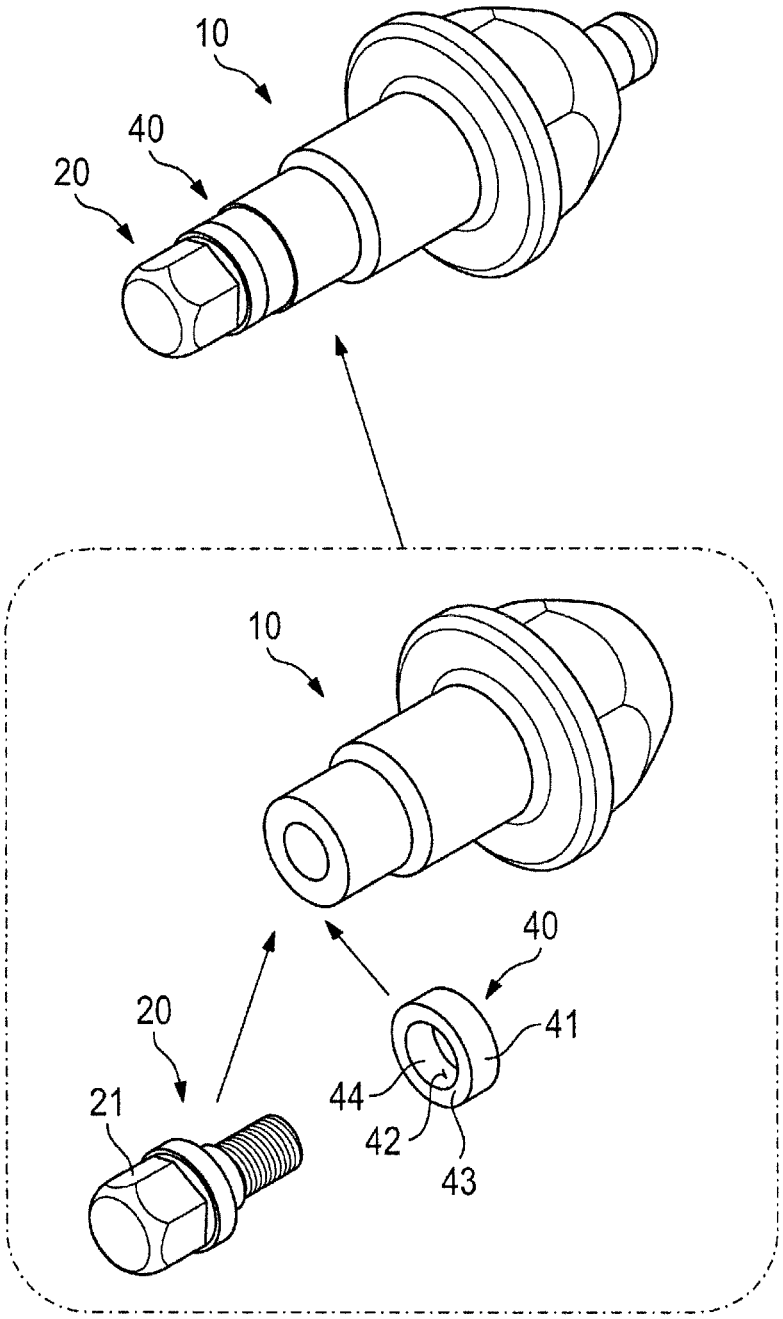
FIG. 10 shows the shank chisel according to FIG. 9 in a perspective illustration of the assembly.
Figure 11:
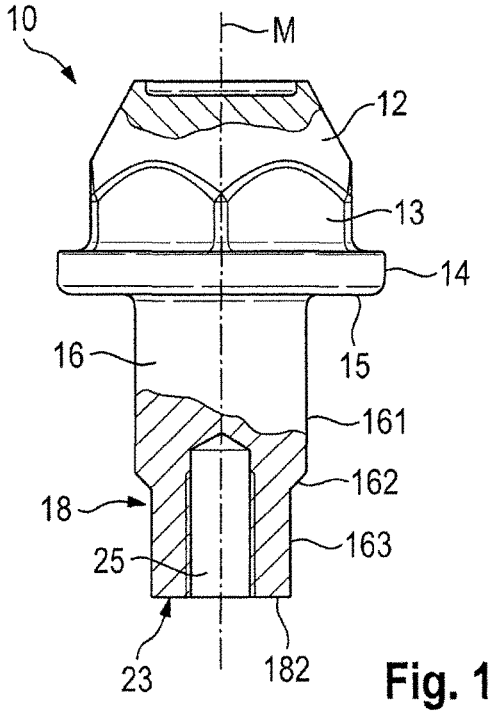
FIG. 11 shows the shank chisel according to FIG. 10 in a side view and in partial section.
Figure 12:
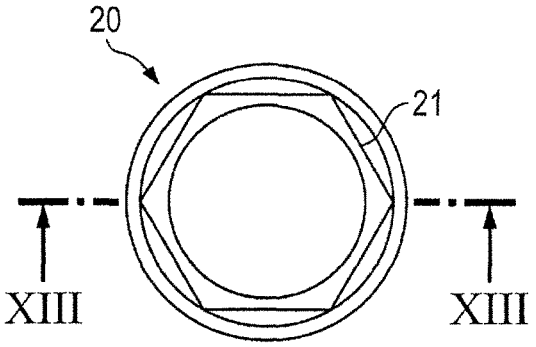
FIG. 12 shows a clamping element of the shank chisel according to FIG. 9 in top view.

For the installation of the shank chisel, as FIG. 10 reveals, the securing element 40 is now pushed with its aperture 44 onto the connecting element 184. The clamping element 20 can subsequently be screwed into the receptacle 25. In the process, the securing element 40 comes with its two securing element end surfaces 43 into contact with the first functional surface 182 and the second functional surface 262. The securing element inner surface 42 is arranged in the region of a cylindrical portion of the connecting element 184. The cylindrical portion forms the lateral functional surface 183, as FIG. 13 shows. A stop 186 is provided in the transition region of the cylindrical portion to the threaded portion of the connecting element 184. If the shank chisel 10 is then mounted in the chisel holder, the shank chisel can be rotated in relation to the clamping element until the stop 186 is placed onto the first functional surface 182 and therefore limits the screwing-in movement. This has the advantage that, firstly, the clamping element 20 can be braced captively in its threaded connection. Secondly, the screwing-in movement of the clamping element 20 is also limited, and therefore a minimum volume of the securing element receptacle 181 cannot be different. This has the advantage that the securing element 40 is not impermissibly squeezed and therefore cannot be damaged. In this respect, the cylindrical region of the clamping element, which region forms the lateral functional surface 183, forms a spacer 185.

In the variant embodiment according to FIGS. 1 to 6, the functions are taken on by the stop 186 of the connecting element 184 (see FIG. 4 and the stop surface 23 of the clamping element 20).

During the operational use, because of the loadings acting on the shank chisel in shock-like manner, the supporting region 33 of the chisel holder and/or the supporting surface 13 of the chisel head are/is subject to a wear, for example, a deformation. In order nevertheless to be able to maintain a reliable fastening of the shank chisel here, the repositioning spaces 17 are present in both variants of the tool. The shank chisel can be repositioned axially into the repositioning spaces when wear is present. Since the clamping element 20 is also held in the sliding seat in the clamping element receptacle 31, repositioning can also take place here via the space 32.

The described exemplary embodiments clarify the simple possible installation and removal of the shank chisel 10 according to the present invention to form/remove a fixing assembly 1 according to the invention. This can take place by means of a wrench or a similar tool. A contribution is likewise made to the simple installation by the fact that the fastening unit 18 consisting of the shank chisel 10, the clamping element 20 and the securing element 40 can be preassembled, as is apparent from FIGS. 2 and 8.

The described rotation-free securing of the shank chisel 10 in the chisel holder 30 and the step-like shank design and the provision of repositioning spaces also contribute to wear-optimized operation and, in the same manner as the securing in the axial direction, promote safe operation.

The invention claimed is:

1. A tool having a chisel holder in which a shank chisel is mounted, the shank chisel comprising a chisel head and a chisel shank, the chisel shank comprising a clamping element and a securing element receptacle in which a securing element is arranged to secure the shank chisel within a receptacle of the chisel holder, the receptacle of the chisel holder comprises a center longitudinal axis that is radially surrounded by a plurality of flat shaped surfaces that axially extend over a predetermined distance, such that each flat shaped surface is connected to an immediately adjacent flat shaped surface via a circular recess therebetween, and the clamping element comprises a cap portion that is bounded circumferentially by a plurality of flat shaped holding surfaces that correspond to and lie against the plurality of flat shaped surfaces in the receptacle of the chisel holder, wherein the clamping element is adjustably coupled to the chisel shank such that adjustment of the clamping element deforms an outer contour of the securing element thereby producing a clamping effect between the chisel shank and the chisel holder.

2. The tool as claimed in claim 1, wherein the chisel shank and the clamping element are connected in an infinitely adjustable manner to each other via a connecting element and the securing element receptacle.

3. The tool as claimed in claim 2, wherein the adjustment of the clamping element relative to the chisel shank is limited by means of a stop.

4. The tool as claimed in claim 1, further comprising a chisel tip composed of hard material with a hardness of at least 25 GPa, which is fastened to the chisel head.

5. The tool as claimed in claim 4, wherein the chisel tip is composed of hard material with a hardness of greater than 40 GPa.

6. The tool as claimed in claim 1, wherein the chisel head has a tool receptacle for securing a tool in an interlocking manner in a circumferential direction.

7. The tool as claimed in claim 1, wherein at least one part of the chisel shank is formed in a step-like manner by a first cylindrical portion, a transition and a second cylindrical portion.

8. The tool as claimed in claim 1, wherein the chisel shank, the clamping element and the securing element form a fastening unit.

9. The tool as claimed in claim 1, wherein the securing element has an annular securing element outer surface, an annular securing element inner surface and two radially directed securing element end surfaces.

10. The tool as claimed in claim 9, wherein the securing element is at least partially composed of elastic material.

11. The tool as claimed in claim 1, wherein the clamping element has a holding surface for twist proof securing on the chisel holder.

12. A fixing assembly for a shank chisel in a receptacle of a chisel holder, the shank chisel comprises a chisel head and a chisel shank, the chisel shank together with a clamping element form a securing element receptacle for a securing element to secure the shank chisel within the receptacle of the chisel holder, the receptacle of the chisel holder comprises a center longitudinal axis that is radially surrounded by a plurality of flat shaped surfaces that axially extend over a predetermined distance, such that each flat shaped surface is connected to an immediately adjacent flat shaped surface via a circular recess therebetween, and the clamping element comprises a cap portion that is bounded circumferentially by a plurality of flat shaped holding surfaces that correspond to and lie against the plurality of flat shaped surfaces in the receptacle of the chisel holder, wherein the clamping element is adjustably coupled to the chisel shank, such that adjustment of the clamping element changes the volume of the securing element receptacle and deforms an outer contour of the securing element thereby producing a clamping effect between the chisel shank and the chisel holder.

13. The fixing assembly as claimed in claim 12, wherein the securing element is deformable, by changing the volume of the securing element receptacle, and deforming the outer contour of the securing element creates clamping forces on the surrounding walls of the securing element receptacle, to achieve fixing in an axial direction between the shank chisel and the chisel holder.

14. The fixing assembly as claimed in claim 12, wherein a minimum volume of the securing element receptacle is limited by a spacer.

15. The fixing assembly as claimed in claim 12, wherein the clamping element is one of mounted in a twist proof manner in the receptacle of the chisel holder, or in that the clamping element is guided in an axially displaceable manner in the receptacle of the chisel holder.

16. The fixing assembly as claimed in claim 12, wherein the receptacle of the chisel holder is formed in a step-like manner by a first cylindrical region, a transition region and a second cylindrical region.

17. The fixing assembly as claimed in claim 16, wherein a transition of the shank chisel and the transition region f the receptacle of the chisel holder are spaced apart axially from each other to form a repositioning space.

* * * * *